US009222266B1

(12) United States Patent
Conboy

(10) Patent No.: US 9,222,266 B1
(45) Date of Patent: Dec. 29, 2015

(54) HINGED METAL CONNECTORS AND JOINT CONSTRUCTIONS

(76) Inventor: John S. Conboy, Chesterfield, MO (US)

( * ) Notice: Subject to any disclaimer, the term of this patent is extended or adjusted under 35 U.S.C. 154(b) by 891 days.

(21) Appl. No.: 10/810,374

(22) Filed: Mar. 27, 2004

Related U.S. Application Data

(60) Provisional application No. 60/458,630, filed on Mar. 28, 2003, provisional application No. 60/468,849, filed on May 6, 2003.

(51) Int. Cl.
*E04B 1/38* (2006.01)
*E04F 13/06* (2006.01)

(52) U.S. Cl.
CPC ..... *E04F 13/06* (2013.01)

(58) Field of Classification Search
CPC ... E06B 1/2688; E06B 1/2612; E06B 1/2616; E04F 13/06; E04F 13/063
USPC ..... 52/255, 287.1, 288.1, 282.2, 282.3, 52/282.4, 698, 712, 715, 254–257; 403/231; D21/120, 121; D8/403
See application file for complete search history.

(56) References Cited

U.S. PATENT DOCUMENTS 1,308,773 A * 7/1919 Clark ..... 52/255
2,084,758 A * 6/1937 Anderson ..... 403/231
2,181,530 A 11/1939 Davenport
2,314,523 A 3/1943 Speer
2,862,264 A 12/1958 Perna
3,323,264 A * 6/1967 Cross ..... 52/281
T887,014 I4 6/1971 Overbay et al.
4,185,566 A * 1/1980 Adams ..... 108/152
4,313,991 A 2/1982 Lamb
4,611,448 A * 9/1986 De Long ..... 52/239
4,722,153 A 2/1988 Hardy
4,835,925 A 6/1989 Hoffmann, Sr.
4,863,774 A 9/1989 Tucker
5,037,686 A 8/1991 Conboy
5,356,103 A * 10/1994 McClurg ..... 248/220.22

(Continued)

FOREIGN PATENT DOCUMENTS

AT 1801529 1/1929

*Primary Examiner* — William Gilbert
(74) *Attorney, Agent, or Firm* — Polster Lieder

(57) ABSTRACT

A method of preventing disruption of a taped finished drywall board joint in a room having a center ridge member and angularly inclined ceiling rafters which involves a metallic connector positioned between the wallboard sections and the ridge member and rafters. The connector has two metallic wings with a center longitudinal bendable connection. The wings have flexible tabs at their free edges which are attached to the rafters and the connector itself is attached to the wallboard adjacent to the ridge member. The wallboard also is attached to the rafters 8-12 inches from the edges of the wings. Because the tabs can bend away from the wings, this construction allows the joint to flex if the rafters warp or shrink without disrupting the finish coating on the outside of the wallboard joint at the ridge member. The connector also can be applied to other critical joints in a home where the framing members are subject to movement such as flat ceilings to avoid truss uplift or rafter movement. The wings have longitudinal corrugations in the wings and tabs to strengthen the tape. In one embodiment two wings are connected by a polymeric tape. In another embodiment, the connector is a unitary metallic part with a longitudinal line of perforations connecting the wings along the centerline to allow the connector to be bent to form the two diverging wings.

11 Claims, 6 Drawing Sheets

(56) References Cited

U.S. PATENT DOCUMENTS

| | | | | |
|---|---|---|---|---|
| 5,368,907 | A | 11/1994 | Conboy | |
| 5,418,027 | A | 5/1995 | Conboy | |
| 5,442,886 | A | 8/1995 | Jacobelli | |
| 5,531,052 | A * | 7/1996 | Agar | 52/489.2 |
| 5,752,353 | A | 5/1998 | Koenig et al. | |
| 5,778,617 | A * | 7/1998 | Free | 52/255 |
| 5,797,694 | A * | 8/1998 | Breivik | 403/231 |
| 5,904,016 | A | 5/1999 | Koenig et al. | |
| 5,943,835 | A * | 8/1999 | von Saint-George | 52/287.1 |
| 6,101,780 | A * | 8/2000 | Kreidt | 52/712 |
| 6,171,043 | B1 * | 1/2001 | Williams | 411/466 |
| 2003/0131546 | A1 * | 7/2003 | Kunz | 52/255 |

* cited by examiner

FASTEN CONNECTOR TABS TO RAFTERS AND ALIGN EDGES OF WINGS INTO STRAIGHT LINE

FASTEN WALLBOARD TO CONNECTOR ONLY ADJACENT TO RIDGE BOARD

FASTEN WALLBOARD TO RAFTERS PAST EDGES OF HINGED METAL CONNECTOR

APPLY CONVENTIONAL DRYWALL TAPE AND DRYWALL COMPOUND OVER ROOM SIDE OF JOINT AND FINISH

HINGED METAL CONNECTORS AND JOINT CONSTRUCTIONS

CROSS-REFERENCE TO RELATED APPLICATIONS

This application is related to my Provisional application Ser. No. 60/458,630 filed Mar. 28, 2003 entitled Hinged Drywall Tape and Joint Construction and my Provisional application Ser. No. 60/468,849 filed May 6, 2003 entitled Hinged Metal Connector and claims priority from said applications.

STATEMENT REGARDING FEDERALLY SPONSORED RESEARCH OR DEVELOPMENT

Not Applicable.

FIELD OF THE INVENTION

This invention relates to a metal connector construction designed to be positioned between roof rafters and a drywall ceiling and along room corner joints and in bay windows. In one embodiment, the connector is a composite having metallic wings and a plastic hinge. This invention also relates to a metallic connector that has perforations along the hinge line to form two wings and the wings have bendable metal tabs which can be connected to ceiling rafters to allow for movement in the structural members without a break in the taped finish drywall joint at the apex of the ceiling. The connector also is useful in combating a problem called truss uplift.

BACKGROUND OF THE INVENTION

Wallboard joints conventionally are finished by applying drywall compound to the joint, positioning a drywall tape over the compound and the joint, coating the taped joint with additional drywall compound, and smoothing the compound into a smooth joint which can be painted to obviate any trace of the joint. The inventor of this application has other United States patents on different forms of drywall tape, including U.S. Pat. Nos. 5,418,027 and 5,037,686.

These tapes are placed on the exterior surfaces of the drywall sections where two sections join to assist in providing a smooth joint surface after the drywall compound is applied, sanded and painted over. The present connector is designed to be positioned beneath the drywall board and affixed both to the drywall and to the support stud or rafter to prevent movement of the wallboard and cracking of the outside taped joint if the support stud or rafter warps or shrinks in size.

In structures having pitched roofs, the roof rafters have one end fastened at a ridge joint and are inclined downwardly so the opposite end butts against a room wall. Drywall is attached directly to the rafters to form a pitched ceiling. Much lumber is not aged adequately or even can be left uncovered on a job site so that it has more moisture than is desirable. When the lumber is installed in a moisture laden condition, it tends to shrink and warp when it dries out. In the case of a pitched ceiling, the wallboard ceiling joints can be pulled apart when the rafters shrink and the contractor is then required to return to a job and repair the wallboard ceiling joints, often after a room is occupied. This is very expensive to the contactor, both in time and money and in loss of reputation for building a quality house. Since many houses using this type construction are custom built and very expensive, this is important to the contractor.

Other places in a home construction where this connector is useful are bay windows and corner joints where the tops of the walls meet the ceiling and which have a tendency to open up if the roof structure shrinks and pulls away from the wall structure. This connector of this invention also can be used on trusses and scissors trusses to combat what is termed truss uplift.

In one embodiment of the invention, the connector includes two metallic wings connected by a flexible polymeric hinge member. The hinge member is glued to the metallic wings and can be folded flat for shipment and storage. The connector can be folded into a V-shape which allows the installer to hold the connector with one hand and attach it to the roof rafters using a screw gun in his other hand. The connector has sufficient rigidity that it stays relatively straight during installation without collapsing or bending substantially.

Since the plastic hinge covers the joint between the two metal wings, it keeps the outside air from the interior of the room. This is important during installation in cold weather months, because the drywall mud applied to the interior drywall joint does not cure properly under cold or freezing conditions.

In another form of the invention, the connector is stamped from a single piece of metal and has a line of linear perforations separating two wings. The connector can be bent along the line of perforations to form any desired angle. Other improvements and advantages include a series of corrugations on the wings including the tabs to allow the tabs to elongate and bend if the installer should not position the screw exactly on center in the tab opening. The corrugations strengthen the wings and help the installer position the screws used to fasten the connector to the wallboard members during installation.

Still another advantage of the present invention is that it can be used to form a straight joint for the drywall even with uneven or inconsistent framing because the tabs by which the wings are affixed to the rafters can be bent to straighten the so that the joint where the drywall ends meet is straight.

These and other objects and advantages will become apparent hereinafter.

SUMMARY OF THE INVENTION

The invention resides in a novel metallic connector and drywall ceiling construction in which the connector of this invention is positioned adjacent to the ceiling rafters between the underside of the ceiling drywall and the ceiling rafters beneath the ridge board. The connector allows movement of the rafters while maintaining the wallboard, and the wallboard outer finish tape and drywall compound, in their fixed position to resist cracking of the taped joint between the wallboard sections where they join beneath the ridge board.

BRIEF DESCRIPTION OF THE SEVERAL VIEWS OF THE DRAWINGS

In the drawings, wherein like numbers and letters refer to like parts wherever they occur.

DETAILED DESCRIPTION OF THE INVENTION

Figure 1:
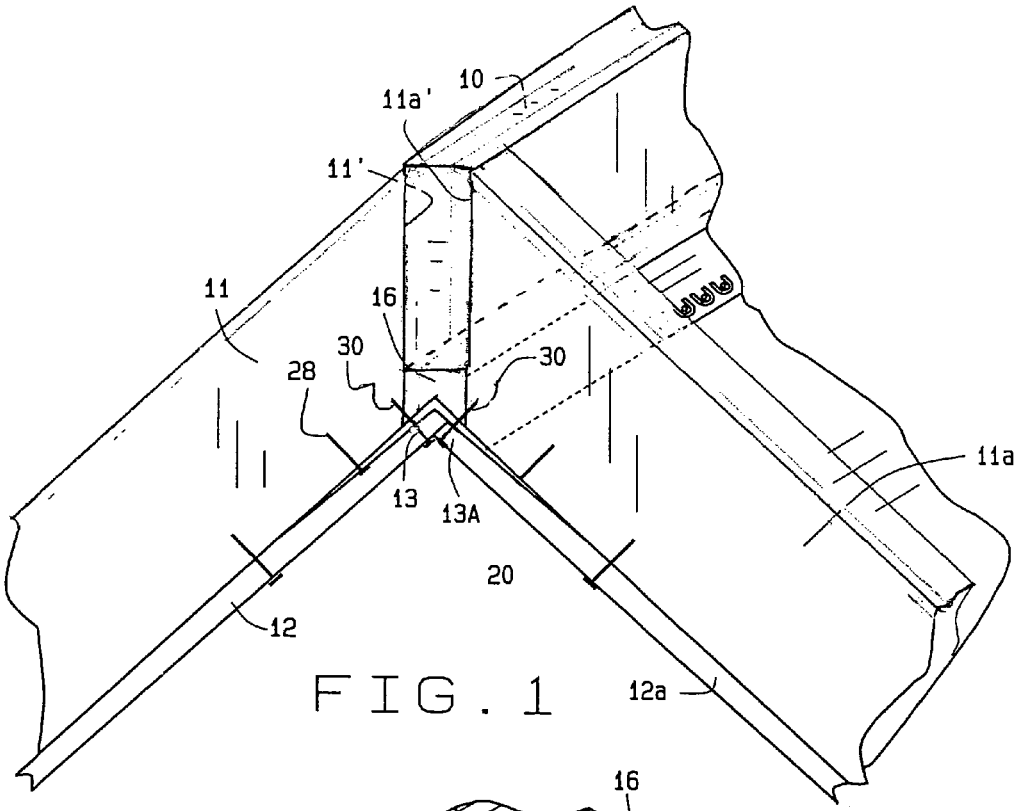
FIG. 1 is a fragmentary perspective view of a ceiling and ridge construction showing wallboard installed over one modification of the connector of this invention, but not showing the finish tape and drywall compound.

FIG. 1 shows a typical vaulted ceiling room structure which includes a ridge board 10 and inclined ceiling rafters 11,11*a* which butt against the ridge board 10 and are fastened thereto. Since the rafters 11,11*a* are cut on an angle, the cut edges 11', 11*a*' are longer than the width of the ridge board 10 which leaves a space 16 beneath the ridge board 10. Fastened to the ceiling rafters 11,11*a* in a conventional structure are drywall boards 12,12*a* whose inner ends 13,13*a* abut beneath the ridge board 10 in the space 16. Conventional drywall tape 14 (FIG. 3) is positioned over the joint between the abutting edges 13,13*a*, and the tape 14 is covered by drywall compound 15 which is finished smooth by the taper. The drywall tape 14 can be of various conventional types but a preferred form of the tape 14 is covered by U.S. Pat. Nos. 5,418,027 and 5,037,686 owned by the inventor of this application and sold under the trademark STRAIT-FLEX® by Strait-Flex International, Inc. of St. Louis, Mo. This installation is satisfactory and works well as long as the ceiling rafters 11, 11*a* remain stable. However, many rafters are made from lumber which is green, i.e., has not been dried sufficiently, or the lumber may have been left uncovered on site and picked up moisture from rain or excess humidity. When lumber having excess moisture is used, it eventually dries and shrinks or warps. When this happens, the wallboard sections 12,12*a*, being tied to the rafters 11,11*a*, move and pull away from the tape 14 and the compound 15 cracks and gaps open along the taped edge. This requires that the contractor revisit the site and repair the damage, often after the house has been occupied for some time and the room filled with furniture, thus complicating the repair.

This invention contemplates the installation of a hinged connector 20 between the ceiling rafters 11,11*a* and the wallboard sections 12,12*a* beneath the ridge board 10 where the wallboard edges 13,13*a* abut.

Figure 3:
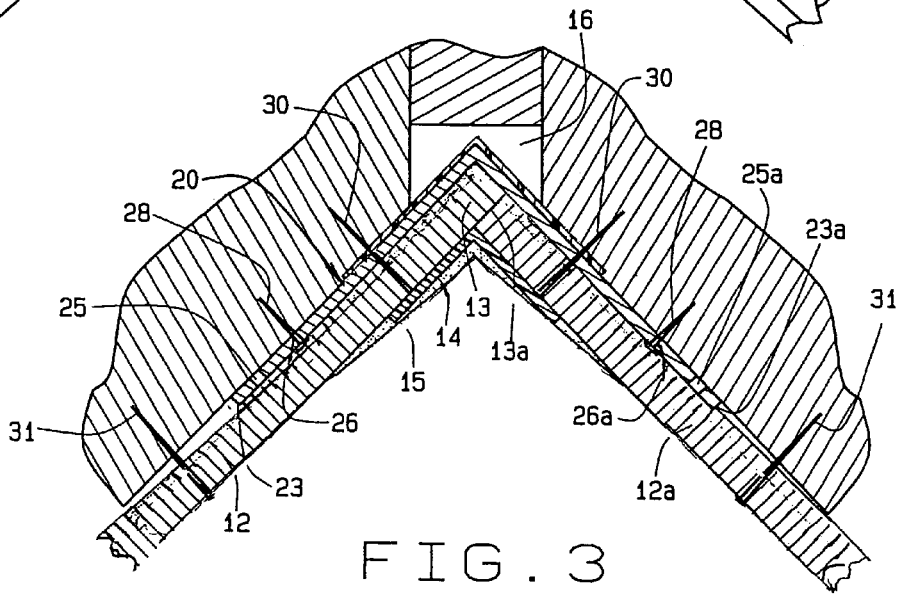
FIG. 3 is an enlarged fragmentary sectional view of a finished joint utilizing the connector shown in FIG. 2.
Figure 2:
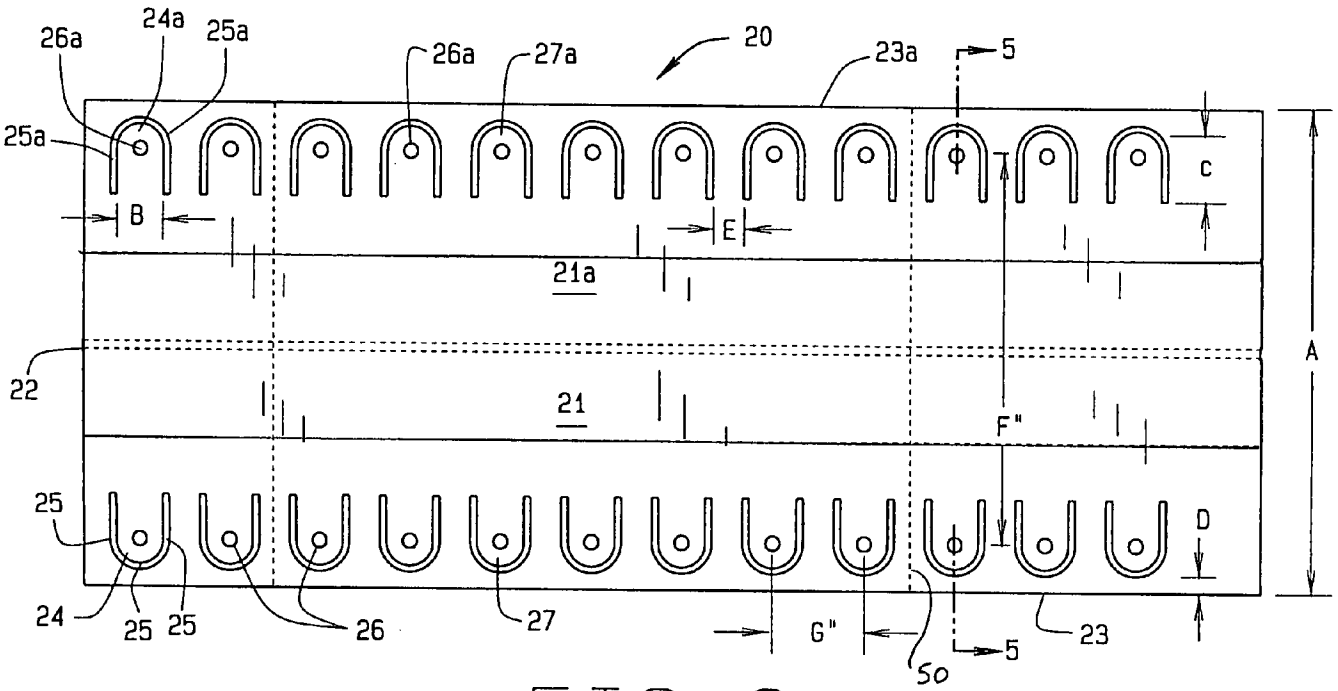
FIG. 2 is a plan view of the one form of the connector of this invention.
Figure 5:
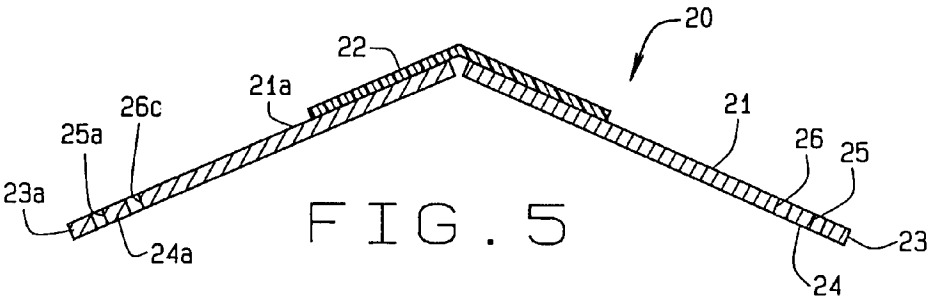
FIG. 5 is a vertical sectional view taken along line 5-5 of FIG. 2.

A first form of the metallic connector 20 is shown in more detail in FIGS. 2 and 5 and is shown installed in FIG. 3. It comprises two separate metallic wings 21,21*a* which are connected by a polymeric hinge member 22 (FIG. 5). The wings 21,21*a* have free longitudinal edges 23,23*a*. Positioned adjacent to the wing edges 23,23*a*, but spaced inwardly thereof in the wings 21,21*a* are a series of longitudinally spaced flexible tabs 24,24*a*. Three sides of the tabs 24,24*a* are spaced from the body of the wings 21,21*a* by a series of curved slots 25,25*a*. The fourth side of the tabs 24,24*a* is connected to the body of the wings 21,21*a* so the tabs 24,24*a* are hingedly connected to the wings 21,21*a*. The hinged connections are those sides most remote from the free edges 23,23*a*. The tabs 24,24*a* are formed with fastener openings 26,26*a* adjacent to the tab free ends 27,27*a*. The tabs 24,24*a* and slots 25,25*a* are curved and have a generally horseshoe shape to improve their strength and eliminate sharp edges which could injure the installer or catch on clothing or equipment.

The metallic wings 21,21*a* are formed from a rust resistant metal, preferably 26 gauge galvanized steel of about 0.024" in thickness. The plastic hinge 22 preferably is polyvinyl chloride (PVC) or other flexible plastic having memory. The hinge 22 preferably is PVC of about 0.020" in thickness. The hinge 22 is glued to the wings 21,21*a* by a flexible polyurethane or epoxy glue. The glue must be flexible so it resists cracking away from the metal wings 21, 21*a*. The connector 20 preferably is made in 10 foot sections and packaged in unfolded condition. The installer can then fold the connector into a V-shape which gives it some longitudinal rigidity and allows the installer to hold the connector 20 in one hand while he fastens the tabs 24,24*a* to the rafters 11,11*a* using wallboard screws positioned in the fastener opening 26, 26*a* and a wallboard screw gun held in his other hand. The plastic hinge 22 preferably is attached to the outer side (or the side adjacent to the rafters 11, 11*a* and most remote from the wallboard 12, 12*a*) of the metal wings 21,21*a* (FIG. 5). This form of the connector also can be formed in 100 foot rolls and sold in rolled condition. Lateral perforations 50 are formed in the connector at 10 foot intervals to allow the installer to sever 10 foot sections from the roll without having to use a metal cutter.

Figure 4A:
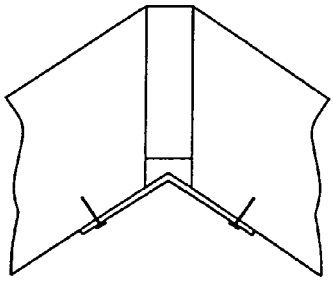
FIGS. 4A-4D are schematic views showing the process of installing the connector of this invention to form a joint according to this invention.
Figure 4B:
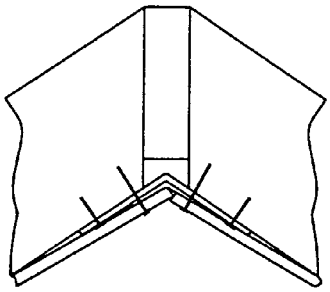
Figure 4C:
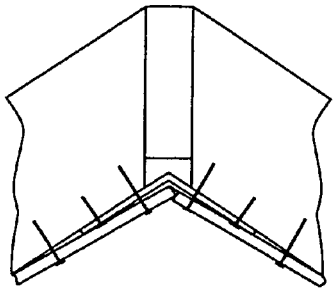
Figure 4D:
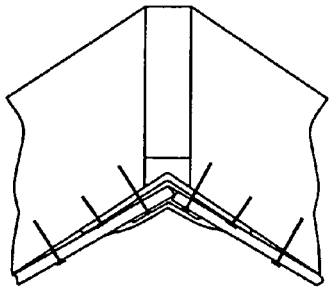

As shown in FIG. 3 and described schematically in FIG. 4A, the hinged connector 20 is first attached to the ceiling rafters 11, 11*a* by positioning fasteners 28 through the tab openings 26,26*a* to attach the tabs 24, 24*a* to the ceiling rafters 11, 11*a*. This is done before installation of the drywall sections 12,12*a*. The fasteners 28 preferably are screws.

After the tabs 24,24*a* are fastened to the rafters 11,11*a*, the installer can check the alignment of the connector 20 and bend the connector to correct for any out of line rafters or other imperfections in the framing by removing screws and adjusting alignment and refastening screws.

Figure 10:
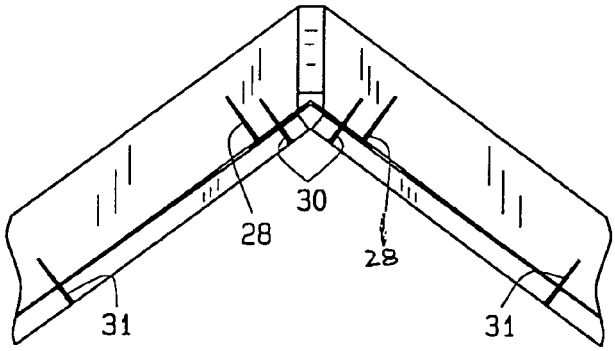
FIGS. 10 and 10A are fragmentary views partly broken and partly diagrammatic of the placement of the fastener screws.
Figure 10A:
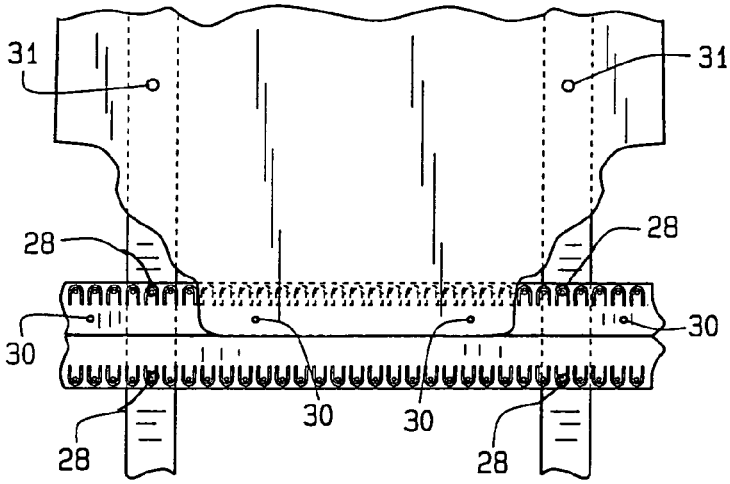
Figure 11:
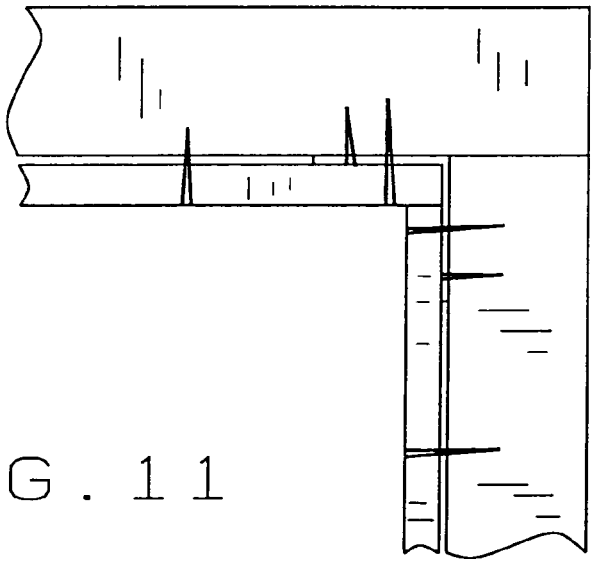
FIG. 11 is a fragmentary view showing the connector applied to a wall and flat ceiling joint.

The drywall boards 12,12*a* then are installed over the hinged metal connector 20. The drywall boards 12,12*a* are fastened only to the wings 21,21*a* and not to the rafters 11,11*a* by fasteners 30 which are positioned adjacent to the connector center 22 and to the drywall board ends 13,13*a* where they abut beneath the ridge board 10. The fasteners 30 also pass through the polymeric plastic hinge 22 and help fasten the hinge member 22 to the wings 21,21*a*. The fasteners 30 also preferably are screws. This installation is shown in FIGS. 10 and 10A. The screws 30 are 2-4 inches from the center of the rafters 11, 11*a*.

The drywall boards 12,12*a* also are fastened to the rafters 11,11*a* past the free edges 23,23*a* of the connector 20 by fasteners 31. The fasteners 31 are positioned at least about 8-12 inches from the center joint where the wallboards 12, 12*a* meet and 6-8 inches past the connector edges 23,23*a*. This allows the drywall boards 12,12*a* to flex from the edges of the wings into engagement with the rafters 11,11*a*. This construction allows the rafters 11,11*a* and the wallboard to move without moving the drywall joint. The tabs 24,24*a* will bend and flex and move with the rafters 11,11*a* while the joint between the wallboard members 12,12*a* stays in place.

After the wallboard sections 12,12*a* are installed over the connector 20, the wallboard joints are finished in a conventional manner. In other words, drywall compound 15 is applied to the joints between the sections; drywall tape then is applied to the flat joints between the drywall sections 12,12*a*; and angular joint tape 14 is applied to the ridge joint where the wallboard edges 13,13*a* meet. These tapes then are coated with drywall compound 15 which is finished off by the taper.

If the rafters 11,11*a* warp or shrink, the tabs 24,24*a* will move and relieve any stress that may be placed on the finished joints and the dried compound 15. This prevents the dried compound 15 from cracking and ruining the joints.

FIGS. 4A-4D show in block diagrams the steps in installing wallboard according to this invention.

1st Step: The hinged connector 20 is attached to the rafters 11,11*a* by fastening the tabs 24,24*a* to the rafters 11,11*a* with fasteners 28.

2nd Step: The drywall boards 12,12*a* are placed in position and fasteners 30 are driven only through the wallboard members 12,12*a* and through the metal wings 21,21*a* and the plastic hinge 22 of the connector 20 adjacent to the ridge board 10.

3rd Step: The wallboard members 12,12*a* are also fastened to the rafters 11,11*a* at least 6 inches away from the free edges 23,23*a* of the connector 20 to allow for the drywall to flex during rafter movement.

4th Step: Conventional drywall tape 14 and drywall compound 15 is applied over the room side of the joints and the joints are finished.

The preferred connector 20 has certain preferred dimensions. The connector 20 preferably is fabricated in 10 foot lengths. The connector 20 has a preferred width "A" of about 4 inches. The tabs 24,24*a* have a width "B" of about 0.375" and a length "C" of about 0.5623". The slots 25,25*a* have a width of about 0.0625". The distance "D" between the wing free edges 23,23*a* and the edges of the slots 25,25*a* is about 0.125". The spacing "E" between longitudinal tab slots is about 0.25". The openings 26,26*a* are about 0.125" in diameter and the distance "F" between the openings 26,26*a* is about 3.25". The distance "G" between adjacent tab openings 26, 26*a* is 0.75" which causes all openings 26, 26*a* to be aligned with a rafter 12, 12*a* regardless of where the connector is cut. These distances are preferred, but other size connectors can have relative dimensions.

The rafters 11,11*a* normally are 1½" in thickness and on 24" centers. As noted, the connector 20 is designed so that the tabs 24,24*a* are aligned with the rafters 11,11*a* no matter what the rafter spacing.

OTHER EMBODIMENTS OF THE INVENTION

FIGS. 6-11 show other embodiments of the invention which comprises a connectors 40, 51, 60 which are suitable for use in all of the installations hereinbefore described. The discussion and drawings referenced to FIGS. 1-5 are incorporated into this and the following description to the extent necessary to complete the disclosure and understanding of the invention.

Figure 6:
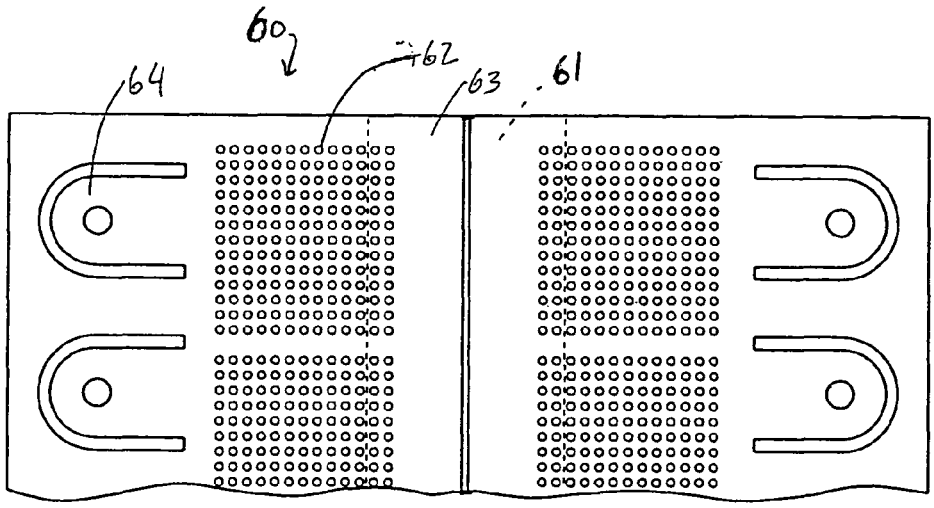
FIG. 6 is a plan view of another modification of the connector of this invention in flattened condition.
Figure 7:
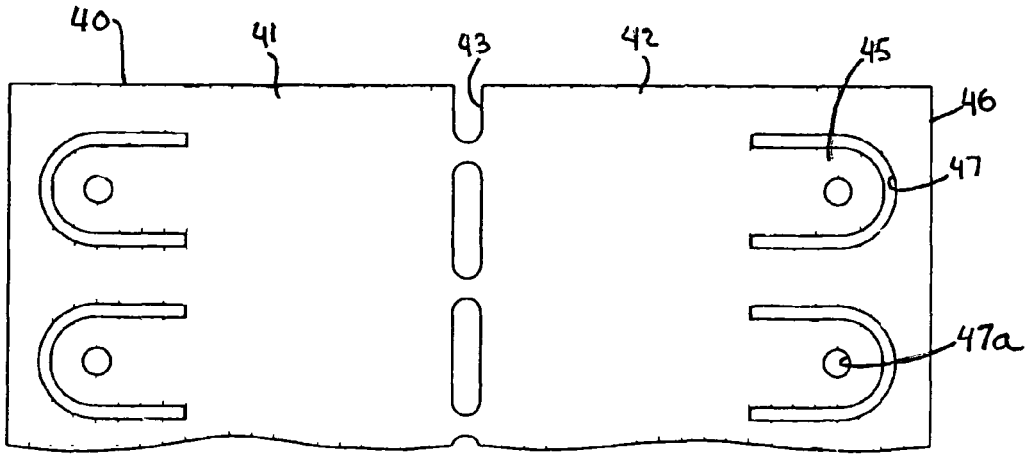
FIG. 7 is a plan view of another modification of the invention.
Figure 8:
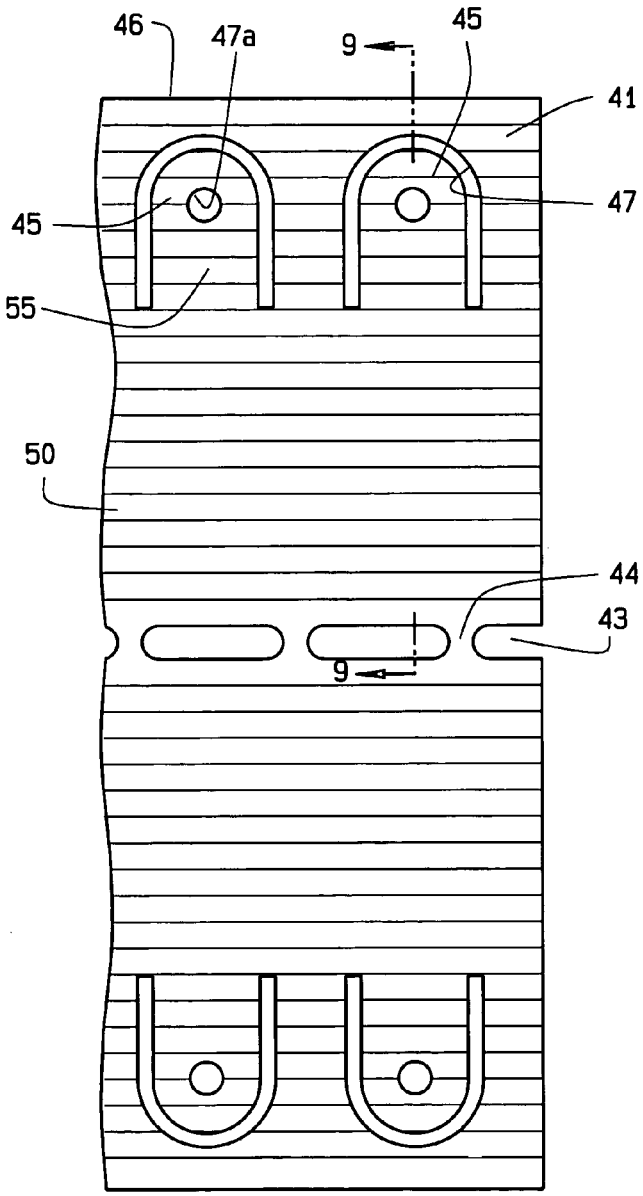
FIG. 8 is an enlarged fragmentary plan view of the modification shown in FIG. 7.

The connector 60 shown in FIG. 6 has a polymeric hinge 61 and is provided with a series of indentations 62 or dimples between the center of the wings 63 and the tabs 64. The dimples have a concave side adjacent to the wallboard and act to guide the screws straight into the connector. This connector is suitable for being shipped in 100 foot rolls.

The connectors 40, 51 shown in FIGS. 7-9A are other modifications of the invention. The connector 40 is formed from a unitary metal sheet and has two longitudinal wings 41,42 separated by a hinge line defined by longitudinal perforations 43. The perforations 43 are about 19/32 inches in length and are separated by bars 44 about 1/32 inch in length. The perforations 43 have rounded corners to avoid sharp edges and to facilitate bending. The rounded corners help the connector to fold at the apex. The connector 40 preferably is made of 24 gauge galvanized metal and is about 0.22 to about 0.24 inches in thickness.

The wings 41,42 have longitudinally spaced tabs 45 positioned adjacent to the free longitudinal edges 46 but spaced inwardly thereof. Three sides of the tabs 45 are spaced from the body of the wings 41,42 by a series of curved slots 47. The fourth side of the tabs 45 is connected to the body of the wings 41,42 so the tabs 45 are hingedly connected to the wings 41,42 on the sides most remote from the free edges 46. Screw openings 47*a* are located in the tabs 45 adjacent to the free ends 46. The dimensions of the connector 40, the wings 41, 42, the tabs 45, and the slots 46 preferably are similar to or the same as the dimensions denominated by the letter "A"-"G" for similar parts and spaces in FIG. 2.

Figure 9:
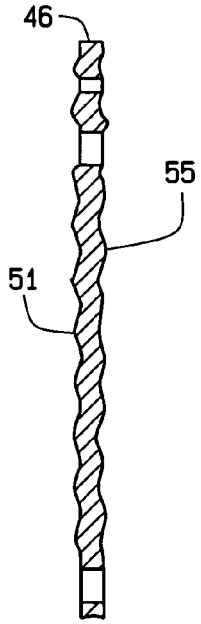
FIG. 9 is a sectional view taken along line 9-9 of FIG. 8.
Figure 9A:
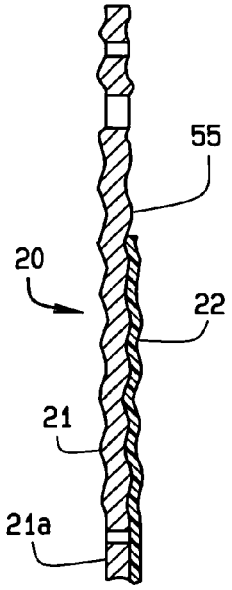
FIG. 9A is a view similar to FIG. 8 showing a connector with a polymeric hinge.

The constructions of FIGS. 7-9A may have lateral corrugations 55 in the body of the wings 41, 42 including the tabs 45. The lateral curved areas 55 increase the longitudinal and lateral rigidity of the connector 51 and are designed to straighten out if the connector 51 is stressed and this allows for additional movement of the structural members in that it allows the tabs 45 to elongate under stress. The corrugated connector 51 is designed to be sold in 10 foot stick length. When the wings are corrugated and the polymeric hinge tape are used together, the tape is secured in the corrugations which enhances the bond strength between the tape and the wings. (FIG. 9A)

In view of the above it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

What is claimed is:

1. A method for attaching wallboard to a pitched ceiling structure, wherein the pitched ceiling structure comprises a plurality of first rafter boards connected at an angle to a first side of a ridge board, and a plurality of second rafter boards connected at an angle to an opposing second side of the ridge board, said method comprising:

fastening a flat connection member to the first and second rafter boards, wherein the flat connection member comprises:

a flat longitudinal hinged center section extending the length of the connector member, the flat hinged center section comprising a longitudinal hinge extending the length of the center section; and a pair of opposing flat lateral wings connected together by the center section and extending laterally away from the hinge, the hinge being unfolded such the connector member is flat prior to fastening the connection member to the first and second rafter boards, the pair of opposing wings comprising:

a first wing structured and operable to be disposed between one or more first panels of wallboard and the first rafter boards, the first wing comprising:

a free longitudinal edge; and a row of bendable first tabs disposed along a length of the first wing and within an interior portion of the first wing between the hinged center section and the free longitudinal edge, the first tabs being disposed coplanarly with the interior portion of the first wing such that the first wing is flat, each first tab comprising a fastener opening structured and operable to have a fastener inserted therethrough to connect the respective first tab, and hence the first wing, to the plurality of first rafter boards; and a second wing structured and operable to be disposed between one or more second panels of wallboard and the plurality of second rafter boards, the second wing comprising:

a free longitudinal edge; and a row of bendable second tabs disposed along a length of the second wing and within an interior portion of the second wing between the hinged center section and the free longitudinal edge, the second tabs being disposed coplanarly with the interior portion of the second wing such that the second wing is flat, each second tab comprising a fastener opening structured and operable to have a fastener inserted therethrough to connect the respective second tab, and hence the second wing, to the plurality of second rafter boards, wherein fastening the flat connection member to the first and second rafter boards comprises:

folding the flat connection member along the length of hinge to form any angle between the opposing lateral wings;

inserting a fastener through the fastener opening of selected first tabs;

fastening each of the selected first tabs to a respective one of the first rafter boards, via the fasteners;

inserting a fastener through the fastener opening of selected second tabs; and fastening each of the selected second tabs to a respective one of the second rafter boards, via the fasteners;

fastening the first and second panels of wallboard to the connection member, wherein fastening the first and second panels of wallboard to the connection member comprises:

fastening an edge portion of each first panel of wallboard to an area of the first wing other than areas that form the first tabs, via a plurality of fastener, such that the edge portion of each first panel is connected only to the first wing, absent any connection of the first panel edge portion to the first rafter boards; and fastening an edge portion of each second panel of wallboard to an area of the second wing other than areas that form the second tabs, via a plurality of fastener, such that the edge portion of each second panel is connected only to the second wing, absent any connection of the first panel edge portion to the second rafter boards; and fastening portions, other than the edge portions, of the first and second panels of drywall to the respective first and second rafter boards.

2. A flat connector member for applying between structural members and wallboard members at a wallboard joint to allow the structural members to move without disrupting the wallboard joint, said connector member comprising:

a flat longitudinal hinged center section extending the length of the connector member, the flat hinged center section comprising a longitudinal hinge extending the length of the center section and structured and operable to be folded along the length of the hinge upon installation of the connector member; and a pair of opposing flat lateral wings connected together by the center section and extending laterally away from the hinge, the hinge being unfolded, to form a flat connector member, the pair of opposing wings comprising:

a first wing structured and operable to be disposed between one or more first panels of wallboard and a plurality of first rafter boards, the first wing comprising:

a free longitudinal edge; and a row of bendable first tabs disposed along a length of the first wing and within an interior portion of the first wing between the hinged center section and the free longitudinal edge, the first tabs being disposed coplanarly with the interior portion of the first wing such that the first wing is flat, each first tab comprising a fastener opening structured and operable to have a fastener inserted therethrough to connect the respective first tab, and hence the first wing, to the plurality of first rafter boards upon installation of the connector member; and a second wing structured and operable to be disposed between one or more second panels of wallboard and a plurality of second rafter boards, the second wing comprising:

a free longitudinal edge; and a row of bendable second tabs disposed along a length of the second wing and within an interior portion of the second wing between the hinged center section and the free longitudinal edge, the second tabs being disposed coplanarly with the interior portion of the second wing such that the second wing is flat, each second tab comprising a fastener opening structured and operable to have a fastener inserted therethrough to connect the respective second tab, and hence the second wing, to the plurality of second rafter boards upon installation of the connector member, wherein, the hinge is structured and operable to be folded along the length of the hinge upon installation of the connector member to form any desired angle between the opposing wings.

3. The connector of claim 2 wherein the wings are metal and the center section hingedly connects said wings.

4. The connector of claim 3 wherein the tabs are attached to the wing area along their innermost edge and have openings around the sides and outermost edges.

5. The connecting member of claim 4 wherein the wings and the tabs have longitudinal corrugations therein.

6. The connector of claim 4 wherein a wing area between the tabs and the center section contains a series of dimples.

7. The connector of claim 3 wherein the center section comprises a hinge member constructed of a polymeric material.

8. The connector of claim 7 wherein the hinge member is constructed polyvinyl chloride.

9. The connector of claim 7 wherein the wings are about 0.022 to about 0.026 inches in thickness and the hinge member is about 0.020 inches in thickness.

10. The connector member of claim 3 wherein the wings and center section are unitary and metallic.

11. The connector member of claim 10 wherein the longitudinal hinge is comprised of a series of disconnected longitudinal slots separated by smaller segments disposed longitudinally along the center section.

* * * * *